US006318438B1

(12) United States Patent
Uno et al.

(10) Patent No.: US 6,318,438 B1
(45) Date of Patent: Nov. 20, 2001

(54) NET GUIDE FOR SIDE-SLIDING WIRE SCREEN

(75) Inventors: Akihiko Uno; Mitsuhiko Chino, both of Tokyo (JP)

(73) Assignee: Seiki Hanbai Co., Ltd., Tokyo (JP)

( * ) Notice: Subject to any disclaimer, the term of this patent is extended or adjusted under 35 U.S.C. 154(b) by 0 days.

(21) Appl. No.: 09/550,801

(22) Filed: Apr. 18, 2000

(51) Int. Cl.[7] ..... A47H 1/00

(52) U.S. Cl. ..... 160/31; 160/84.06; 160/194; 160/271

(58) Field of Search ..... 160/84.06, 31, 160/194, 201, 240, 268.1, 271, 272, 277, 279

(56) References Cited

U.S. PATENT DOCUMENTS 1,425,484 * 8/1922 Jenkins .
1,882,982 * 10/1932 Schmiedeskamp .
1,948,262 * 2/1934 Gabriel .
4,557,309 * 12/1985 Judkins .
4,858,668 * 8/1989 Toti .
4,862,941 * 9/1989 Coloson .
5,377,737 * 1/1995 Moriya et al. .
5,873,401 * 2/1999 Tsuchida .
5,937,929 * 8/1999 Chen .
6,186,212 * 2/2001 Tsuchida .

FOREIGN PATENT DOCUMENTS 8-28160 1/1996 (JP) .

* cited by examiner

*Primary Examiner*—Blair M. Johnson
(74) *Attorney, Agent, or Firm*—Oblon, Spivak, McClelland, Maier & Neustadt, P.C.

(57) ABSTRACT

A net guide 12 is guided along the lower end of an expandable net 4 folding in alternate directions counter to each other, made capable of opening/closing sideways is formed as a long member having a U-shaped cross-section including a shaking preventive section 12*a* and a bottom 12*b*. Concave notches 12*c* arranged at certain intervals are out in the shaking preventive section 12*a*.

20 Claims, 8 Drawing Sheets

NET GUIDE FOR SIDE-SLIDING WIRE SCREEN

INDUSTRIAL FIELD OF THE INVENTION

The present invention relates to a net guide for a side-sliding wire screen. More particularly, the invention relates to a net guide which inhibits shaking of the net by accessing to any one of frames attached to the both ends of the net in response to expansion/contraction of the net, and being introduced along the upper end or the lower end of the net in the stretched state to hold the end thereof.

DESCRIPTION OF THE RELATED ART

For a wire screen in which an expandable accordion-shaped net made by alternately folding can be opened and closed by side sliding, it is the usual practice to insert the upper and lower ends of the net into grooves in the frame to inhibit deflection of the upper and lower ends of the net bending before the wind, or to prevent insects from entering.

However, the frame into which the ends of the net are to be inserted is usually installed fixedly to an opening of the building even when housing the folded net, and this prevents smooth passage of those who enter or leave the building through the opening. There is therefore a demand for a frame which can be excluded together with the net upon opening or closing.

To cope with the aforementioned demand, several proposals have already been made of frames into which the ends of the net are inserted, permitting exclusion together with the net upon housing the folded net (for example, Japanese Unexamined Patent Application Publication No. 8-28160). However, expansive products or ones highly susceptible to failure through the use for years are not welcome in the market, and there is a demand for a simple structure, a low cost and a sufficiently low susceptibility to failure.

DISCLOSURE OF THE INVENTION

The present invention was developed to solve these conventional problems, and has a technical object to provide a net guide for a side-sliding wire screen which is easily manufacturable at the lowest possible cost.

Another technical object of the invention is to enable to easily provide a net guide made multi-functional by imparting not only the function preventing shaking of the net, but also functions of side guiding for opening and closing the net and preventing the net from coming off through engagement with the net.

To achieve the aforementioned objects, the present invention provides a net guide for a side-sliding wire screen in which an expandable net alternately folded in directions counter to each other slides sideways, and which inhibits shaking of the net by entering/leaving the interior of any of frames attached to the both ends of the net in response to expansion or contraction of the net, and by being guided along the upper end or the lower end of the net in a stretched state to hold the upper end or the lower end; wherein a long member having a substantially U-shaped cross-section comprising at least a pair of shaking preventive members and a bottom connecting the both shaking preventive members at intervals with the net in between, and concave notches arranged at certain intervals which allows a deflection of the bottom are provided in the shaking preventive member.

In the aforementioned net guide for a side-sliding wire screen, it is appropriate to provide cut portions at the mouths of concave notches provided in the shaking preventive member for expansion and opening of the mouths, and to provide a guiding ridge for arresting the net at the guiding section at the opening of the net stretching section on each of the both sides of the back of the bottom of the long member along the same.

A stopper recess or a projection engaging with an stopper section may be provided along the long member having a substantially U-shaped cross-section.

The net guide having the above-mentioned configuration is used for inhibiting shaking of the net by, in response to expansion or contraction formed by folding in directions counter to each other, entering and leaving the interior of any one of frames attached to the both ends of the net, and by being guided along the upper end or the lower end of the net in a stretched state to hold that end. It is basically formed into a long member having a U-shaped cross-section from a soft synthetic resin extruded material, and concave notches are provided at certain intervals in the shaking preventive section. The net guide having such a simple structure and easily manufacturable can be provided as a result at a very low cost, and by imparting a necessary strength to the bottom, the possibility of a failure such as breakage can be almost eliminated.

By using such a configuration, it is easy to cause the net guide to deflect, to enter or leave the interior of the frames attached to the both ends of the net in response to expansion or contraction of the net, and guide it along the upper end or the lower end of the net in the stretched state.

Further, by reducing the width of the concave notch of a certain interval cut in the shaking preventive section and expanding and opening only the mouth of the concave notch to avoid interference upon deflection, the holding function of net ends is improved, and a failure is never caused by a part of the net coming off the concave notch. By engaging the stopper section provided on the net with a stopper recess or a stopper projection of the net guide, it is possible more certainly ensure holding of the ends of the net.

Since the aforementioned net guide is basically formed of an extruded material having a certain cross-section, it is possible not only to achieve a function of preventing shaking, but also to easily form an engaging section for preventing the sliding guide for opening and closing the net and the net from coming off and thus to achieve multiple functions of the net guide.

DESCRIPTION OF THE EMBODIMENTS

Figure 1:
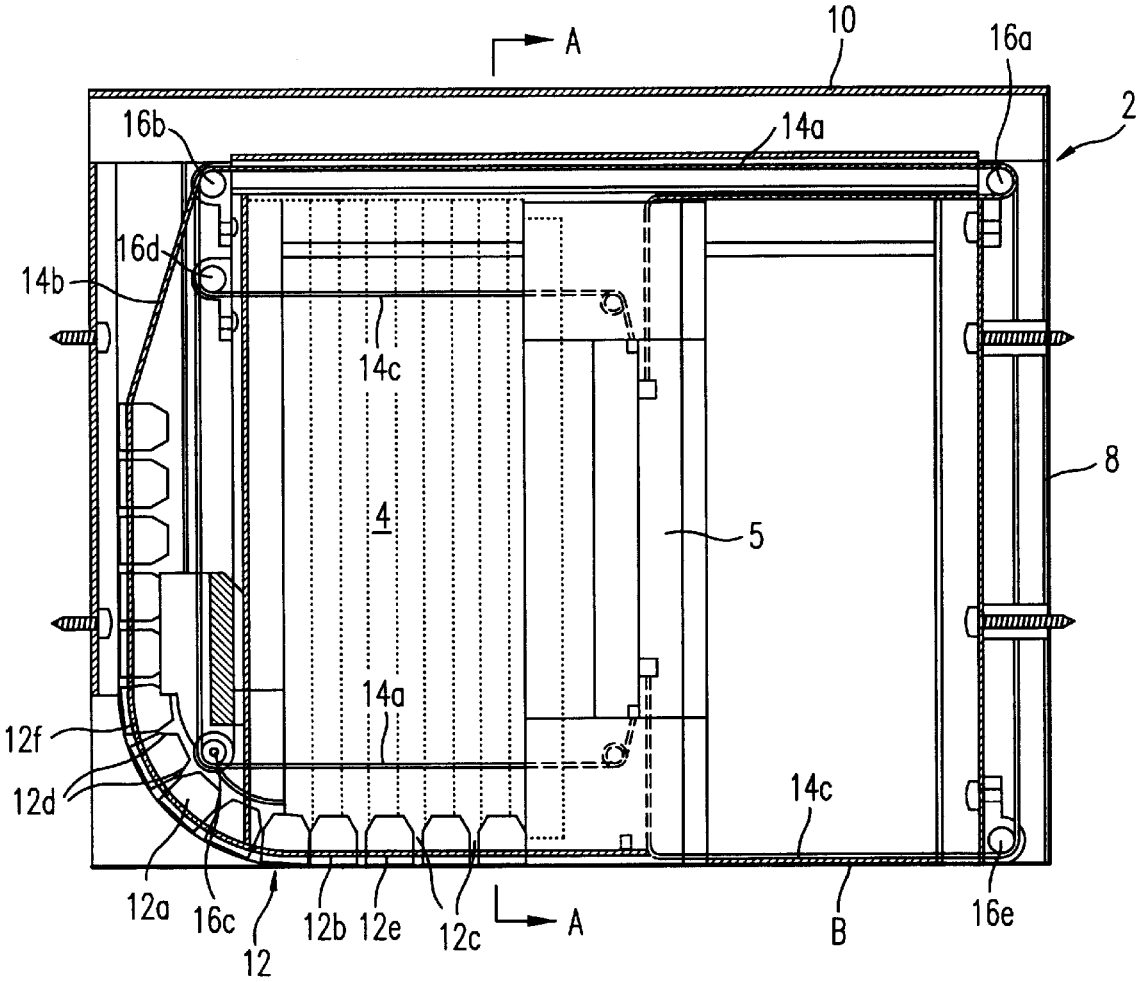
FIG. 1 is a front sectional view illustrating an embodiment of a side-sliding wire screen provided with the net guide of the present invention.
Figure 2:
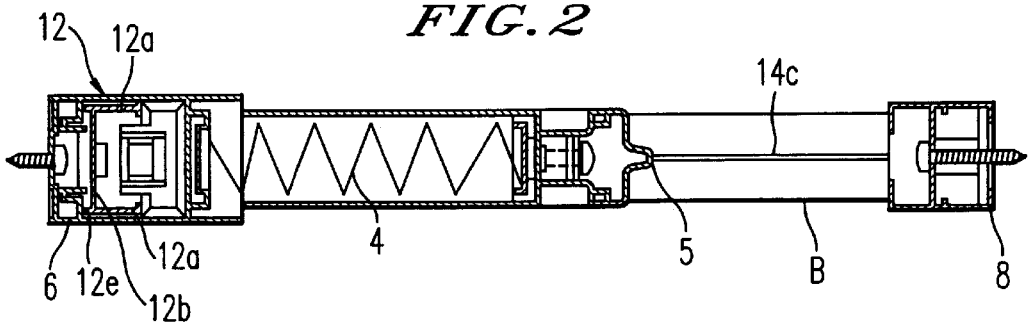
FIG. 2 is a plan sectional view of FIG. 1.
Figure 3:
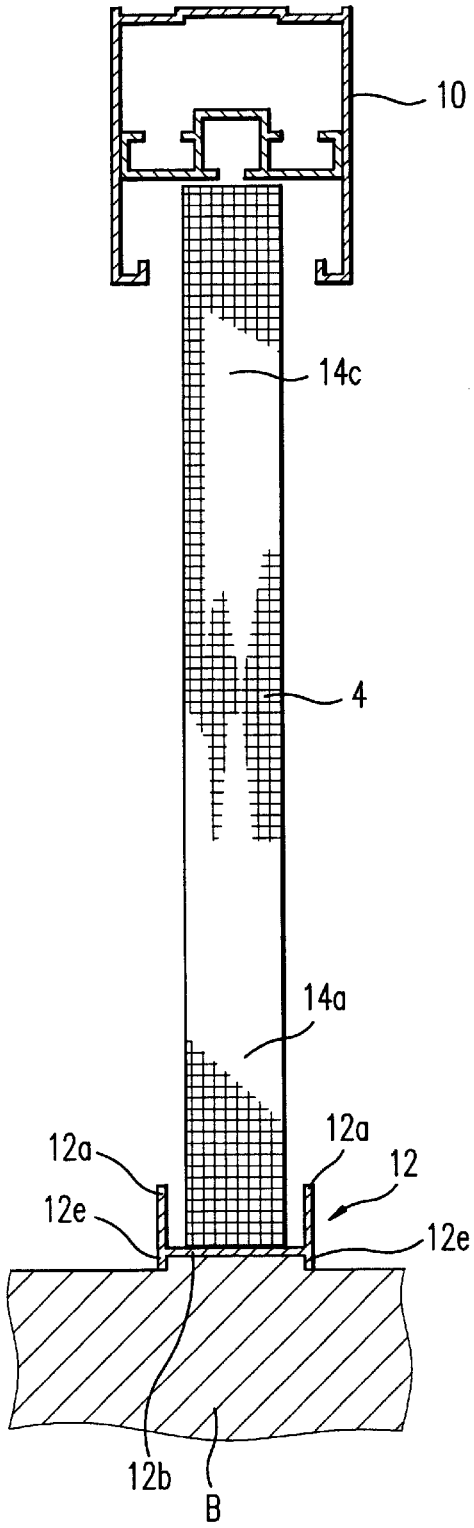
FIG. 3 is an end sectional view of FIG. 1 cut along the line A—A.

FIGS. 1 to 3 illustrate side-sliding wire screen provided with the net guide of the present invention. More specifically, FIGS. 1 to 3 show the aforementioned net guide used in an insert preventive wire screen opening or closing an expandable accordion-shaped side-sliding net.

As shown in FIG. 1, this insect preventive wire screen schematically comprises a frame 2, an insect preventive net 4 attached capable of being opened or closed sideways in the frame 2, a movable enclosure 5 for opening/closing operation attached to an end of the net 4, and a net guide 12.

The frame 2 has right and left longitudinal frame members 6 and 8, and an upper transverse frame member 10. The net guide 12 inhibiting shaking of the net 4 is provided in the lower part of the frame 2 so as to appear or disappear along with a move of the movable enclosure 5. The net guide 12, having an end fixed to the lower end of the movable enclosure 5, enters and leaves the interior of the longitudinal frame member 6 to the left in the drawing, in response to expansion or contraction of the net 4 along with movement of the movable enclosure, and inhibits shaking of the lower end of the net 4 by wind or the like by being guided along the lower end of the net 4 in a stretched state and holding the end.

The net guide 12 is formed by cutting off a part of an extruded material having a substantially U-shaped cross-section comprising a soft synthetic resin. In other words, the extruded material comprises a pair of right and left shaking preventive sections 12*a* and 12*a* as shown in FIG. 3 and a bottom 12*b* connecting the pair of shaking preventive sections 12*a* and 12*a* at intervals necessary for holding the net 4 in between, and is formed in to a long member having a substantially U-shaped cross-section.

Concave notches 12*c* at certain intervals permitting deflection of the bottom 12*b* are cut in the shaking preventive sections 12*a* as shown in FIG. 1. A cut portion 12*d* having substantially a triangular shape expanding and opening the mouth is provided at the mouth of the concave notch 12*c*. The lower end of the concave notch 12*c* is cut in a semi-circular shape. The net guide 12 has guiding ridges 12*e* and 12*e* provided on the back of the bottom 12*b* of the long member having a substantially U-shaped cross-section, and a semi-circular notch 12*f* facilitating deflection of the bottom 12*b* at a position corresponding to the concave notch 12*c* of the shaking preventive section 12*a* in the guiding ridge 12*e*. The guiding ridge 12*e* is to guide appropriate sliding of the net guide 12, i.e., appropriate opening/closing of the net 4 along a guiding section B, by providing the guiding section B having a height substantially equal to that of a doorsill not forming a barrier for walking on the floor of the building opening, and fitting the guiding section B between the both guiding ridges 12*e* and 12*e*, as clearly shown in FIG. 3.

The net 4 is expandable and has an accordion shape by zigzag forming a plurality of pleats, has a frame comprising the longitudinal frame member 6 and the movable enclosure 5, attached to the both ends thereof. The net 4 can be opened and closed with the upper transverse frame member 10 and the lower net guide 12 of the frame 2 as guides by the action of the movable enclosure 5 for opening/closing operation attached to an end of the net 4.

Three stretching cords 14*a*, 14*b* and 14*c* are stretched between the frame 2 and the movable enclosure 5 as a parallel transfer mechanism for causing stable parallel movement of the movable enclosure 5 attached to an end of the net 4.

The first stretching cord 14*a* has an end attached to the upper portion of the movable enclosure 5. The stretching cord 14*a* is hooked around a turnover 16*a* provided on the upper portion of one of the longitudinal frame member 8, passed through the transverse frame member 10, and hooked around another turnover 16*b* provided on the upper portion of the other longitudinal frame member 6 which guiding it down through the longitudinal frame member 6. The stretching cord 14*a* is further hooked around the lower turnover 16*c*, guided from the longitudinal frame member 6 onto the net 4 side, and connected to the lower end of the movable enclosure 5 by passing it through the net 4. The second stretching cord 14*b* branched from the first stretching cord 14*a* has a leading end connected to an inner end of the net guide 12. Further, the third stretching cord 14*c* has an end attached to the lower end of the movable enclosure 5, is hooked around a turnover 16*e* provided in the lower part of the longitudinal frame member 8 to guide it through the longitudinal frame member 8 to the upper end thereof, hooked around the turnover 16*a* provided in the upper part to guide it through the transverse frame member 10, hooked around the turnover 16*b* provided in the upper part of another longitudinal frame member 6 to guide it through the longitudinal frame member 6 downward, hooked around the turnover 16*d* in the upper part of the movable enclosure 5, and passed through the net 4 to connect it to the upper part of the movable enclosure 5. The aforementioned second stretching cord 14*b* may be omitted, or the second stretching cord 14*b* may be used to omit the portion from the longitudinal frame member 6 through the turnover 16*c* to the movable enclosure 5 of the first stretching cord 14*a*. With the latter configuration, the guide 12 can serve as a part of a flexible line composing the parallel it to the upper part of the movable enclosure 5. The aforementioned second stretching cord 14*b* may be omitted, or the second stretching cord 14*b* may be used to omit the portion from the longitudinal frame member 6 through the turnover 16*c* to the movable enclosure 5 of the first stretching cord 14*a*. With the latter configuration, the guide 12 can serve as a part of a flexible line composing the parallel transfer mechanism of the movable enclosure 5 performing opening/closing of the net 4.

In the horizontally stretched portion where the stretching cords 14*a* and 14*c* stretch the net 4, it is possible to prevent the net 4 from loosening and thus to stabilize the stretched status of the net 4 by inserting the stretching cords 14*a* and 14*c* through the net 4. As the aforementioned turnover 16*a* to 16*e*, a sliding member made of a synthetic resin low in resistance with the stretching cords 14*a* to 14*c*, or a pulley made of an appropriate material may be used.

The net guide 12 for a side-sliding wire screen having the above-mentioned configuration enters or leaves the interior of the longitudinal frame member 6 forming the frame 2 attached to an end of the net 4, holds the end while being guided along the lower end of the net in a stretched state, and thus to inhibit shaking of the net.

In addition, the above-mentioned net guide 12 has a basic configuration of a long member having a U-shaped cross-section from an extruded material of a soft synthetic resin, and only concave notches 12*c* at certain intervals are cut on the shaking preventive section 12*a*, leading to a simple structure and easy manufacture. It is therefore possible to provide the net guide 12 at a very low cost, and when a necessary strength is imparted to the bottom 12*b*, it is possible to eliminate the risk of a failure such as a breakage.

As a result of the aforementioned configuration, the net guide 12 can easily defects, and it is easy to cause the net guide 12 to enter and leave the interior of the longitudinal frame member 6 forming the frame 2 attached to an end of the net 4 in response to expansion or contraction of the net 4, and to guide the net guide along the lower end of the net 4 in the stretched state.

Further, by avoiding interference upon deflection by expanding and opening only the mouth of the concave notch 12*c* through reduction of the width of the concave notches 12*c* at the certain intervals cut in the shaking preventive section 12*a,* it is possible to improve the holding function of the end of the net 4, and a part of the net never causes a trouble by coming off the concave notch 12*c*.

The net guide 12 may have a configuration so as to enter or leave the movable enclosure 5, not the longitudinal frame member 6, through the lower end thereof, or it may be provided so as to be capable of entering or leaving one of the longitudinal frame members or the movable enclosure as in the case described above.

While the net guide for a side-sliding wire screen of the invention has basically the structure as described in the above-mentioned embodiment, it may take as required the shape as shown in FIGS. 4A to 4L and 5A to 5K.

In the following embodiments, the portions not particularly explained mean those having the same configuration as in the aforementioned net guide 12. The configuration other than those related with there net guides is substantially the same as in the aforementioned embodiment.

Figure 4A:
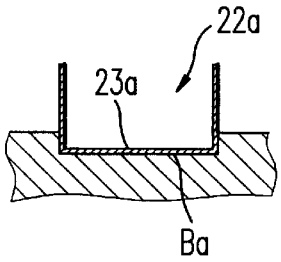
FIGS. 4A to 4L are sectional views illustrating another embodiment of the net guide.
Figure 5A:
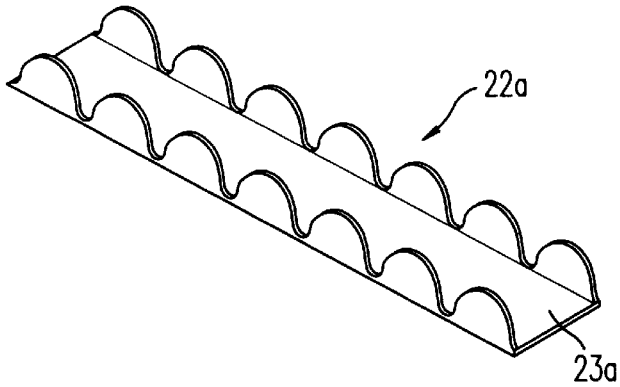
FIGS. 5A to 5K are perspective views of the net guide shown in FIGS. 4A to 4L as viewed from diagonally above or below.

First, the net guide 22A shown in FIGS. 4A and 5A is an embodiment in which a guiding ridge 12*e* is not provided on the back of the bottom 12*b* in the net guide 12 of the preceding embodiment: the net 4 can be opened or closed by fitting a bottom 23A of the guide 22A into a groove-shaped guiding section Ba having a depth of the order of a doorsill.

Figure 4B:
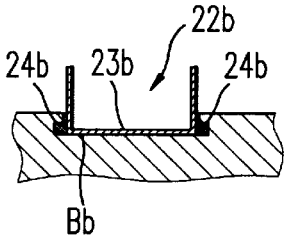
Figure 5B:
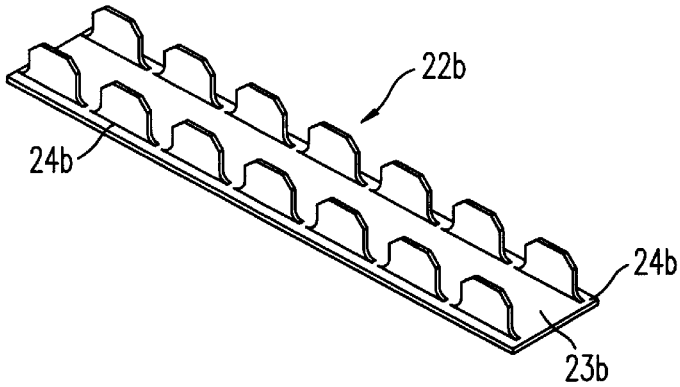

Then, the net guide 22B shown in FIGS. 4B and 5B is an embodiment in which stopper projections 24B and 24B are formed by extending outside the bottom 23B of the net guide 22B: a guide section Bb for stopping the stopper projections 24B and 24B is provided on the floor of a building opening, and the guiding section stops the projections 24B and 24B so as to ensure more stable movement of the net guide 22B.

Figure 4C:
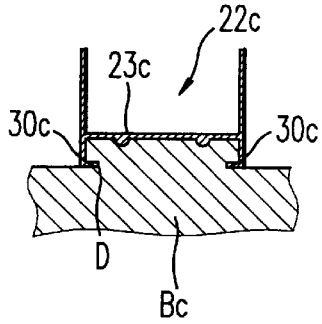
Figure 5C:
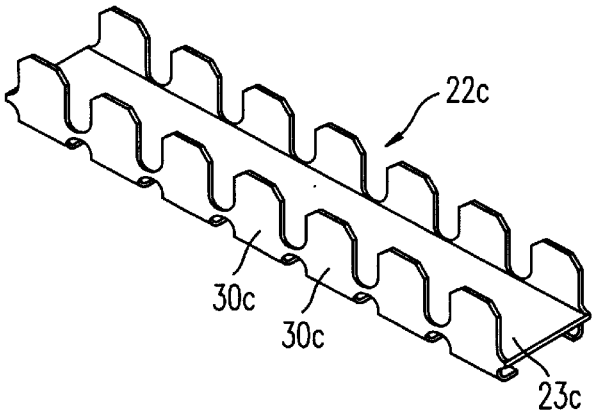

The net guide 22C shown in FIGS. 4C and 5C is an embodiment in which a pair of guiding stopper ridges 30C on the back of the bottom 23C are formed into hook-shaped ridges opposed to each other: this net guide 22C has an object to permit more stable opening/closing of the net 4 by stopping the guiding ridges 30C in the concave grooves D and D formed on both sides of a guiding section Bc of the building opening.

Figure 4D:
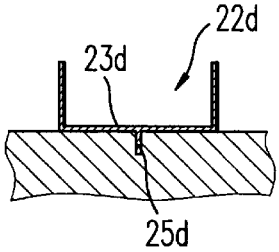
Figure 5D:
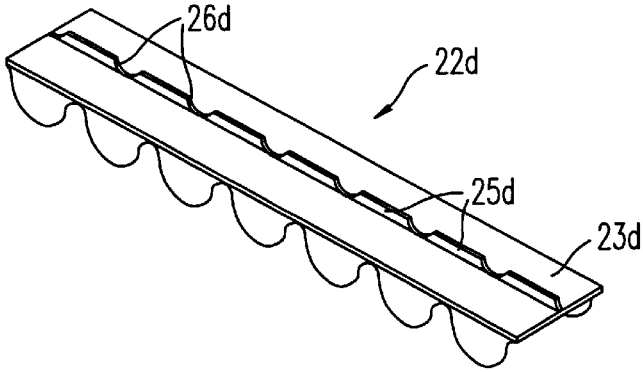

Another embodiment may be used, as shown in FIGS. 4D and 5D not providing a guiding projections on the both sides of the back of the bottom 23D in the net guide 22D, but by providing a sole ridge 25D or the plural number of the ridges 25D at the center.

Figure 4E:
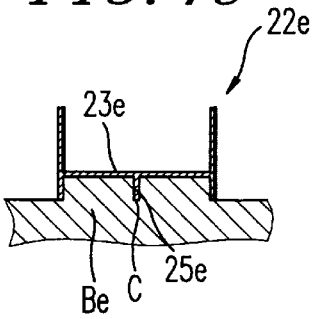
Figure 5E:
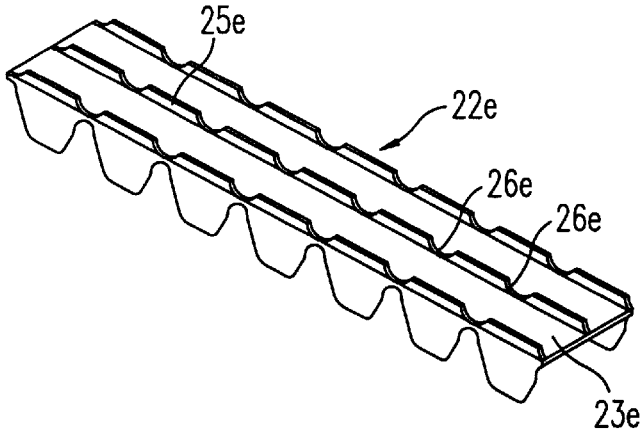

The net guide 22E shown in FIGS. 4E and 5E is an embodiment in which, in addition to the guiding projections 12*e* on the both sides of the back of the bottom 23E corresponding to the bottom 12*b* in the net the bottom at positions corresponding to the concave notch 12*c* of the shaking preventive section 12*a,* for the individual ridges 25D and 25E.

Figure 4F:
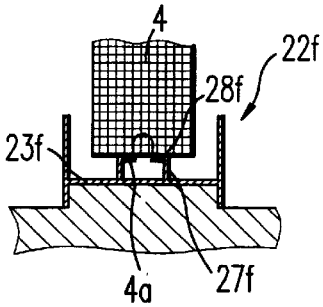
Figure 5F:
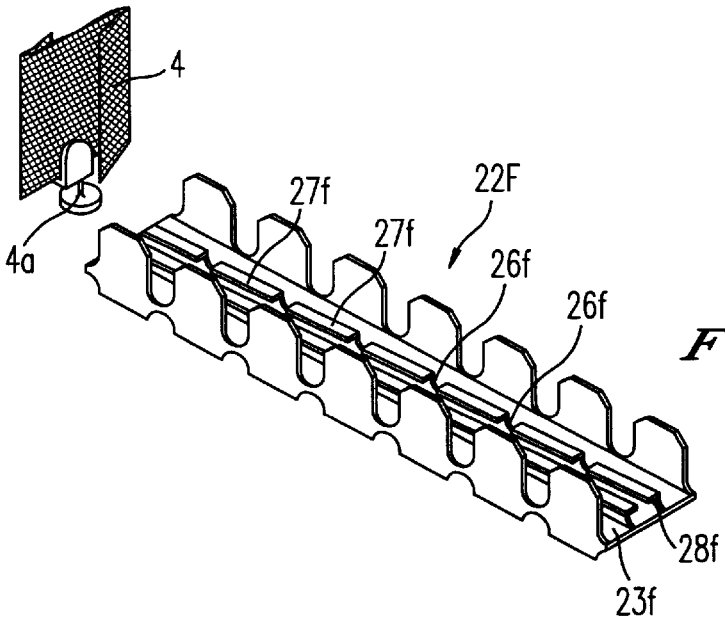

The net guide 22F shown in FIGS. 4F and 5F is an embodiment in which a hollow engagement ridge 27F is formed along the long member at the center of the surface of the bottom 23F, and a slit 28F is provided along the long member at the center of the upper surface of the engagement ridge 27F: it is possible to make more certain holding of the end of the net by causing engagement of stopper pieces 4*a* scattered on the lower end of the net 4 with the slit 28F, thus permitting opening and closing of the net 4 more stably.

Figure 4G:
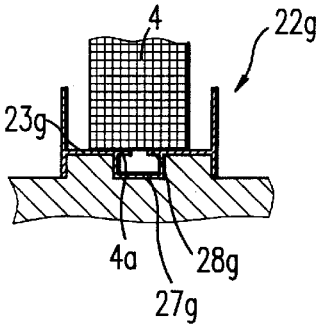
Figure 4H:
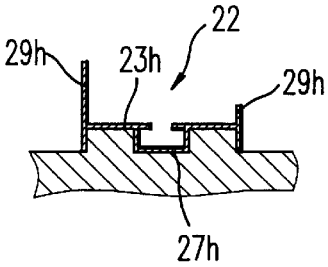
Figure 5G:
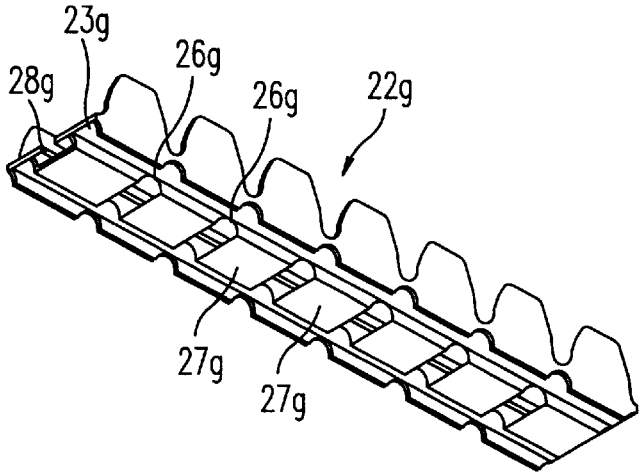
Figure 5H:
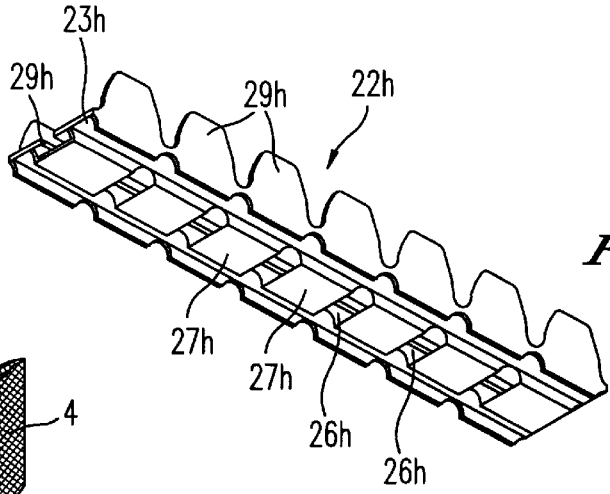

The net guide 22G shown in FIGS. 4G and 5G is an embodiment in which an engagement recess 27G is formed along the long member at the center of the bottom 23G, and a slit 28G is provided at the center of the bottom 23G. As in the above-mentioned net guide 22F, holding of the ends of the net 4 is further ensured by engaging a stopper piece 4*a* provided at the lower end of the net 4 with the slit 28G.

In the case where there is provided means for holding and guiding separately the ends of the net such as an engagement recess or an engagement of the bottom 23G. As in the above-mentioned net guide 22F, holding of the ends of the net 4 is further ensured by engaging a stopper piece 4*a* provided at the lower end of the net 4 with the slit 28G.

In the case where there is provided means for holding and guiding separately the ends of the net such as an engagement recess or an engagement projection engaging with a stopper section provided on the net along the long member as described above, or when installing a wire screen at a place where shaking of the net is rare, holding of the ends of the net is further ensured, and opening/closing of the net is stabilized. In these cases, any one of the pair of the shaking preventive sections 29H can made shorter than the other as in the net guide 22H having an engagement recess 27H provided on the bottom plate 23H shown in FIGS. 4H and 5H.

In these net guides also, it is necessary to provide notches 26F, 26G and 26H facilitating deflection of the bottom, as the notch 12F shown in FIG. 1, in the engagement projection 27F and the engagement recesses 27G and 27H.

Figure 4I:
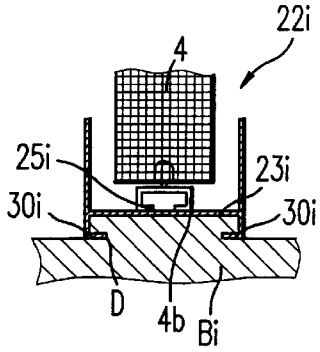
Figure 5I:
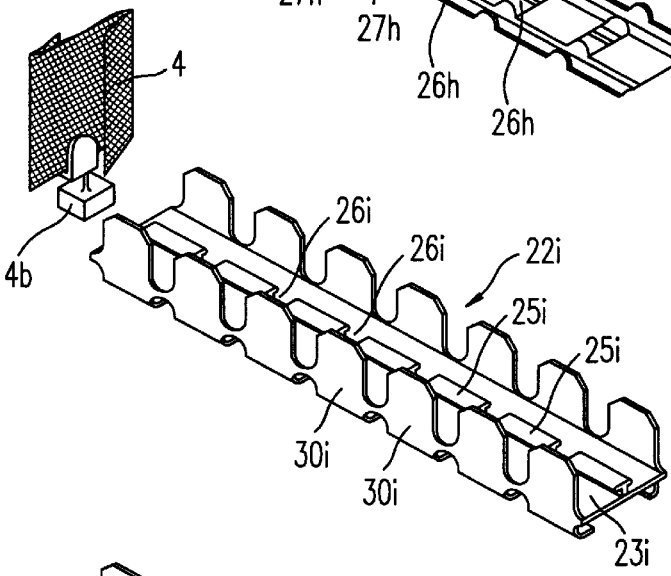

The net guide 22I shown in FIGS. 4I and 5I is an embodiment in which an engagement projection 25I having substantially a T-shaped cross-section is provided at the center of the surface of the bottom 23I along the long member, and a pair of guiding stopper ridges 30I and 30I on the back of the bottom 23I are formed into hook-shaped ridges opposed to each other.

This net guide 22I has an object to permit more stable opening/closing of the net 4 by stopping a concave groove-shaped stopper piece 4*b* provided on the net 4 at a ridge 25I, and stop guiding ridges 30I and 30I in the concave grooves D and D formed on both sides of a guiding section Bi of the building opening.

Figure 4J:
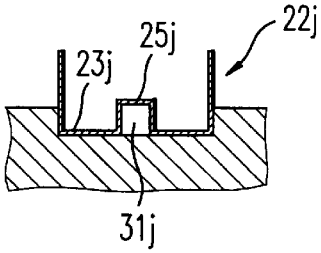
Figure 5J:
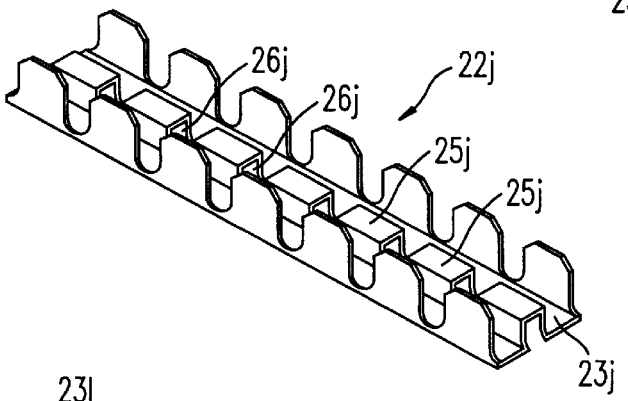

The net guide 22J shown in FIGS. 4J and 5J is an embodiment in which a ridge 25J is provided at the center of the surface of a bottom 23J along a long member: it is possible to use the ridge 25J as a path for a stretching cord 31J forming a parallel transfer mechanism along the long member.

Figure 4K:
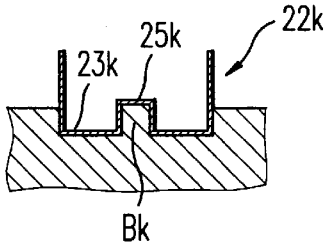

The net guide 22K shown in FIG. 4K is an embodiment in which a projection 25K engaging with a play with a guiding ridge Bk provided at the center of the guiding section, at the center of the surface of the bottom 23K: movement of the net guide 22K can be performed stably by means of the projection 25K. Because the net guide 22K has the same whole shape as that of the net guide 22J shown in FIG. 5J, it is omitted from the drawing.

Figure 4L:
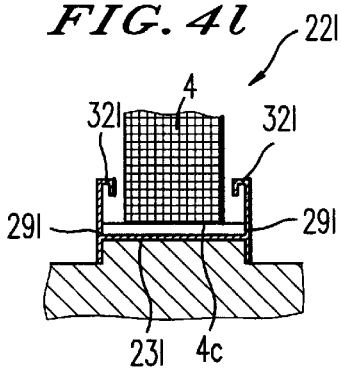
Figure 5K:
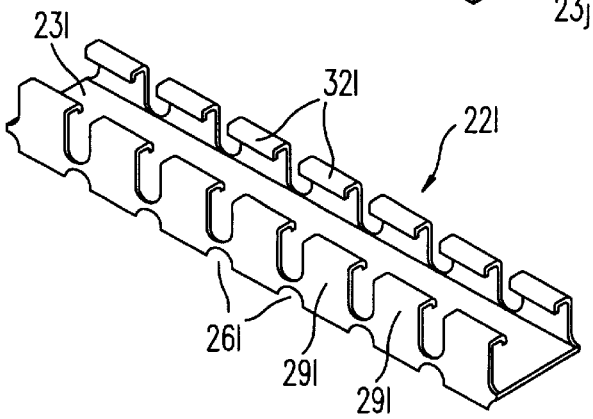

The net guide 22L shown in FIGS. 4L and 5K is an embodiment in which ridges 32L and 32L having substantially a hook shape along the long member are formed on the inner surface at the leading ends of a pair of shaking preventive sections 29L and 29L on the both sides in the width direction of the bottom 23L: holding of the ends of the net 4 is further ensured by providing a disk-shaped stopper piece 4*c* stopping at these rides 32L and 32, at the lower end of the net 4.

Also for these net guides, it is necessary to provide notches 26I, 26J, 26K (not shown) and 26L facilitating deflection of the bottom on the engagement projection 25I and the guiding ridge 30I, the ridges 25J and 25K, and the shaking preventive section 29L.

Since the aforementioned net guide is basically formed of an extruded material having a certain cross-section, as described above, forming an appropriate cross-sectional shape not only brings about a net shaking preventive function, but also permits easy formation of a sliding guide for opening/closing the net and an engaging section for preventing the net from coming off, thus allowing achievement of a multi-functional net guide.

Figure 6A:
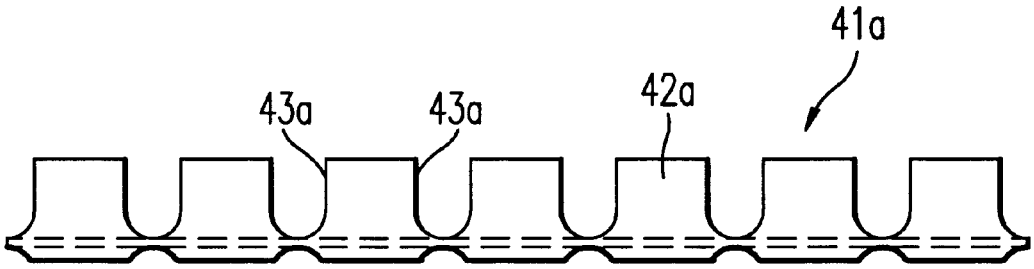
FIGS. 6A and 6B are side views illustrating another embodiment of the shaking preventive section of the net guide.
Figure 6B:
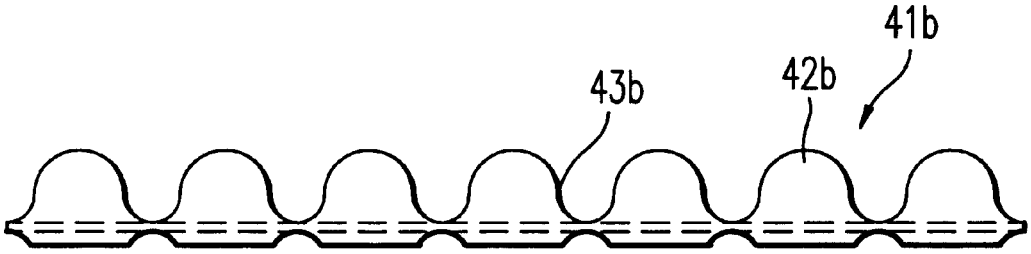

Further, the net guide for a side-sliding wire screen of the prevent invention may have a shaking preventive section of any of the shapes shown in FIGS. 6A and 6B.

More specifically, in the net guide 41A shown in FIG. 6A, a rectangular shaking preventive section 42A is formed by concave notches 43A cut certain intervals having substantially a uniform width, and the lower end of each of the concave notches 43A is cut off in substantially a semi-circular shape.

In the net guide 41B shown in FIG. 6B, concave notches 43B are formed between shaking preventive sections 42B by forming the same into substantially a semi-circular shape and the lower end of each of the concave notches is cut off in substantially a semi-circular shape, to realize the shaking preventive sections 42B as a series of substantially semi-circular shapes.

The shape of the shaking preventive section in the net guide of the invention is not limited to those mentioned above, but any appropriate shape may be adopted as far as it allows deflection of the bottom of the net guide.

As described above in detail, the net guide for a side-sliding wire screen of the invention, which is composed as a long member having a U-shaped cross-section made of an extruded material of a soft synthetic resin, and only concave notches are cut at certain intervals on the shaking preventive sections, has a simple structure is easily manufacturable, and can as a result be provided at a very low cost. If a necessary strength is imparted to the bottom, it is possible to almost eliminate the risk of a failure such as breakage.

Since the net guide itself has an easily deflectable structure, it is possible to cause it to enter or leave the interior of frames attached to the both ends of the net in response to expansion or contraction of the net and to guide it along the upper end or the lower end of the net in the stretched state.

Further, by avoiding interference upon deflection through reduction of the width of the concave notches arranged at certain intervals on the shaking preventive section and expanding and opening only the mouths of the concave notches, it is possible to improve the holding function of the net ends, and a part of the net never causes a failure by coming off the concave notches. If the stopper section provided on the net is engaged with the engagement recess or projection of the net guide, holding of the ends of the net can be made more certain.

Because the net guide is basically made of an extruded material having a certain cross-section, by adopting an appropriate cross-sectional shape, not-only it is possible to impart a net shaking preventive function, but also an engagement section for preventing the sliding guide for opening/closing the net or the net from coming off, thus permitting achievement of a multi-functional net guide.

What is claimed is:

1. A net guide for a side-sliding wire screen in which an expandable net alternately folded in opposite directions slides sideways, which net guide inhibits shaking of said net by entering/leaving an interior of frames attached to ends of said net in response to expansion or contraction of said net, and by being guided along the lower end of said net in a stretched state to hold said lower end, comprising:

a long member having a substantially a U-shaped cross-section comprises at least a pair of shaking preventive members and a bottom connecting the shaking preventive members at intervals with the net in between, and concave notches arranged in said shaking preventive member at certain intervals which allow a deflection of the bottom.

2. A net guide for a side-sliding wire screen according to claim 1, wherein:

cut portions are provided at mouth of the concave notches provided in said shaking preventive member for expansion and opening of the mouths.

3. A net guide for a side-sliding wire screen according to claim 1 or 2, wherein:

a stopper projection for stopping the net at a guiding section is provided at an opening of a net stretching section on both sides of the bottom of the long member along the same.

4. A net guide for a side-sliding wire screen according to claim 1 or 2, wherein:

a guiding ridge for arresting the net at a guiding section provided at the opening of a net stretching section is provided on both sides of a back of the bottom of the long member along the same.

5. A net guide for a side-sliding wire screen according to claim 1 or 2, wherein:

a guiding ridge is provided at the center of a back of the bottom of the long member along the same.

6. A net guide for a side-sliding wire screen according to claim 1 or 2, wherein:

a plurality of guiding ridges are provided on a back of the bottom of the long member along the same.

7. A net guide for a side-sliding wire screen according to claim 4, wherein:

the guiding ridges are provided with notches to facilitate deflection of the bottom.

8. A net guide for a side-sliding wire screen according to claim 1 or 2, wherein:

a stopper projection for engaging with an engaging section provided on the net is provided on the bottom of the long member along the same.

9. A net guide for a side-sliding wire screen according to claim 1 or 2, wherein:

any one of the pair of shaking preventive members in the net guide is shorter in length than the other.

10. A net guide for a side-sliding wire screen according to claim 1 or 2, wherein:

a stopper projection for engaging with an engaging section provided on the net is provided on the bottom of the long member along the same, and a notch for facilitating deflection of the bottom is provided on said stopper projection.

11. A net guide for a side-sliding wire screen according to claim 1 or 2, wherein:

guiding ridges having opposed hooks for arresting the net at a guiding section provided at the opening of a net stretching section are provided on both sides of a back of the bottom of the long member along the same, respectively.

12. A net guide for a side-sliding wire screen according to claim 1 or 2, wherein:

a projection for serving as a path for a stretching cord for moving the net is provided on the bottom of the long member along the same.

13. A net guide for a side-sliding wire screen according to claim 1 or 2, wherein:

a projection for engaging, with play, with the guiding section provided at a opening of the net stretching section is provided on a surface of the bottom of the long member along the same, and a notch for facilitating deflection of the bottom is provided on said projection.

14. A net guide fox a side-sliding wire screen according to claim 1 or 2, wherein:

opposed hooks for more stably opening and closing the net by stopping the same in concave grooves formed on the sides of the guiding section provided at the opening of a net stretching section are provided on a pair of guiding ridges on a back of the bottom, and notches for facilitating deflection of the bottom are provided on these guiding ridges.

15. A net guide for a side-sliding wire screen according to claim 5, wherein:

the guiding ridges are provided with notches to facilitate deflection of the bottom.

16. A net guide for a side-sliding wire screen according to claim 6, wherein:

the guiding ridges are provided with notches to facilitate deflection of the bottom.

17. A net guide for a side-sliding wire screen according to claim 7, wherein:

the guiding ridges are provided with notches to facilitate deflection of the bottom.

18. A net guide for a side-sliding wire screen according to claim 1 or 2, wherein:

a stopper recess for engaging with an engaging section provided on the net is provided on the bottom of the long member along the same.

19. A net guide for a side-sliding wire screen according to claim 1 or 2, wherein:

a stopper recess for engaging with an engaging section provided on the net is provided on the bottom of the long member along the same, and a notch for facilitating deflection of the bottom is provided on said stopper recess.

20. A net guide for a side-sliding wire screen in which an expandable net alternately folded in opposite directions slides sideways, which net guide inhibits shaking of said net by entering/leaving an interior of frames attached to sides of said net in response to expansion or contraction of said net, and by being guided along an end of said net in a stretched state to hold said end, comprising:

a long member having a substantially a U-shaped cross-section comprises at least a pair of shaking preventive members and a bottom connecting the shaking preventive members at intervals with the net in between, and concave notches arranged in said shaking preventive member at certain intervals which allow a deflection of the bottom.

* * * * *